US009925402B2

(12) United States Patent
O'Donnell

(10) Patent No.: US 9,925,402 B2
(45) Date of Patent: Mar. 27, 2018

(54) SMOKE ELIMINATION DEVICE

(71) Applicant: Kevin O'Donnell, Crystal Lake, IL (US)

(72) Inventor: Kevin O'Donnell, Crystal Lake, IL (US)

(73) Assignee: HYDROVENT, LLC, Crystal Lake, IL (US)

( * ) Notice: Subject to any disclaimer, the term of this patent is extended or adjusted under 35 U.S.C. 154(b) by 805 days.

(21) Appl. No.: 14/477,008

(22) Filed: Sep. 4, 2014

(65) Prior Publication Data

US 2016/0069578 A1 Mar. 10, 2016

(51) Int. Cl.

| | |
|---|---|
| ***A62C 37/50*** | (2006.01) |
| ***A62C 31/22*** | (2006.01) |
| ***A62C 31/28*** | (2006.01) |
| *A62B 3/00* | (2006.01) |

(52) U.S. Cl.

CPC ..... *A62C 31/22* (2013.01); *A62C 31/28* (2013.01); *A62B 3/005* (2013.01)

(58) Field of Classification Search

CPC ..... A62C 31/22

USPC ..... 239/271, 276, 140, 231, 280

See application file for complete search history.

(56) References Cited

U.S. PATENT DOCUMENTS

| | | | | |
|---|---|---|---|---|
| 4,703,808 | A | 11/1987 | O'Donnell | |
| 4,779,801 | A | 10/1988 | O'Donell | |
| 7,687,748 | B2 | 3/2010 | Gasas | |
| 2012/0118592 | A1 * | 5/2012 | Lowry | A62C 31/05 169/70 |

FOREIGN PATENT DOCUMENTS

| | | | | |
|---|---|---|---|---|
| GB | 2420093 A | * | 5/2006 | B25D 1/02 |

OTHER PUBLICATIONS

WO 2013/072759A2, Grantham ,ech anical ventilator for use in preventing flashover when fighting fires, Grantham May 23, 2013.*

* cited by examiner

*Primary Examiner* — Helena Kosanovic
(74) *Attorney, Agent, or Firm* — Justin Lampel

(57) ABSTRACT

A smoke eliminator device is provided. The smoke eliminator device is especially suitable for removing smoke from a room or building so as to allow a firefighter to more easily rescue individuals and extinguish fires. The device is a lightweight elongated tube which connects to a standard fire hose. Water emitted from the distal end of the device creates a suction which pulls smoke out of the room or building. A glass-breaking device is located near a distal end of the device to allow the device to easily penetrate a window wherein it may be effective. A cooling nozzle allows for the extinguishing of fire by water spray. An extension may be added to the device to allow the device to be utilized in the upper floor of a building. The device may further have a bend which allows a user to utilize the device directly below a window of an upper floor.

12 Claims, 5 Drawing Sheets

SMOKE ELIMINATION DEVICE

CROSS REFERENCE TO RELATED APPLICATIONS

The following application is based on and claims the priority benefit of U.S. provisional application Ser. No. 61/873,853 filed Sep. 5, 2013; the entire contents of which are incorporated by reference.

BACKGROUND OF THE INVENTION

A smoke eliminator device is provided. The smoke eliminator device is especially suitable for removing smoke from a room or building so as to allow a firefighter to more easily rescue individuals and extinguish fires. The device is a lightweight elongated tube which connects to a standard fire hose. Water emitted from the distal end of the device creates a suction which pulls smoke out of the room or building. A glass-breaking device is located near a distal end of the device to allow the device to easily penetrate a window wherein it may be effective. A cooling nozzle allows for the extinguishing of fire by water spray. An extension may be added to the device to allow the device to be utilized in the upper floor of a building. The device may further have a bend which allows a user to utilize the device directly below a window of an upper floor.

Over the years, attempts have been made to provide a smoke eliminator device. For example, U.S. Pat. No. 4,779,801 to O'Donnell discloses a special, lightweight, easy-to-use apparatus and effective smoke abatement process to efficiently remove smoke and gases from a burning building to minimize smoke damage, asphyxiation, and injury, as well as to accommodate safer quicker exiting of the building's occupants and better visibility for the firemen. The apparatus has a water spray nozzle which is positioned to face away from the fire to create a suction which draws the smoke and gases out of the burning building.

Further, U.S. Pat. No. 4,703,808 also to O'Donnell discloses a smoke eliminator for removing smoke, heat and combustion gases from a burning structure. The smoke eliminator includes a heat-resistant rigid tube having an adapter attached to one end for connection to a conventional fire hose, and a fog nozzle attached to the other end and disposed normal to the tube. A butt section is disposed at right angles to the tube below the fog nozzle and has a number of holding teeth for engaging a structure member such as a window ledge.

Still further, U.S. Pat. No. 7,687,748 to Gagas discloses a method of removing a gas. In particular the patent discloses an indoor or outdoor induction cook top system with integrated downdraft or telescoping ventilator uses cross flow or centrifugal blower technology. The system is controlled by an electronic or mechanical controller through a touch device, a slide, or knob. These provide precise control and an efficient way of removal of gases/fumes. A smooth glass cook top incorporates the induction hobs and a downdraft. The ventilator's blower assembly has a fan and a filter. The system uses sensors to detect temperature, fire, effluent, filter change requirements, fan speed, power, and voltage. The system has programmable operations and numerous set points.

However, these patents fail to describe a smoke eliminator device which is easy to use and efficient as is described in the present application. Further, these patents fail to provide a smoke eliminator device which may easily break the glass of a window so as to allow for easy smoke elimination.

SUMMARY OF THE INVENTION

A smoke eliminator device is provided. The smoke eliminator device is especially suitable for removing smoke from a room or building so as to allow a firefighter to more easily rescue individuals and extinguish fires. The device is a lightweight elongated tube which connects to a standard fire hose. Water emitted from the distal end of the device creates a suction which pulls smoke out of the room or building. A glass-breaking device is located near a distal end of the device to allow the device to easily penetrate a window wherein it may be effective. A cooling nozzle allows for the extinguishing of fire by water spray. An extension may be added to the device to allow the device to be utilized in the upper floor of a building. The device may further have a bend which allows a user to utilize the device directly below a window of an upper floor.

An advantage of the present smoke elimination device is that the device is lightweight.

Still another advantage of the present smoke elimination device is that the device may be connected to a standard fire hose.

Yet another advantage of the present smoke elimination device is that the device may withstand extreme heat.

And another advantage of the present smoke elimination device is that the present device may have an adjustable nozzle which sprays water directly on a fire.

Another advantage of the present smoke elimination device is that the present device may have a glass-breaking device located on the distal end for easily breaking the glass of a window.

Yet another advantage of the present smoke elimination device is that the present device is simple in structure and inexpensive to manufacture and maintain.

And yet another advantage of the present smoke elimination device is that the present device may be operated by a single person.

Still another advantage of the present smoke elimination device is that the present device may be used to elimination dangerous combustion gases from a building.

Still another advantage of the present smoke elimination device is that the present device may have an extension which allows the device to be used on the upper floor of a building.

Another advantage of the present smoke elimination device is that the device pulls smoke and heat away from firefighters and victims.

Yet another advantage of the present smoke elimination device is that the present device may have a bend which allows a user utilize the device directly below a window of an upper floor.

For a more complete understanding of the above listed features and advantages of the present smoke elimination device reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

A smoke eliminator device is provided. The smoke eliminator device is especially suitable for removing smoke from a room or building so as to allow a firefighter to more easily rescue individuals and extinguish fires. The device is a lightweight elongated tube which connects to a standard fire hose. Water emitted from the distal end of the device creates a suction which pulls smoke out of the room or building. A glass-breaking device is located near a distal end of the device to allow the device to easily penetrate a window wherein it may be effective. A cooling nozzle allows for the extinguishing of fire by water spray. An extension may be added to the device to allow the device to be utilized in the upper floor of a building. The device may further have a bend which allows a user to utilize the device directly below a window of an upper floor.

Figure 1:
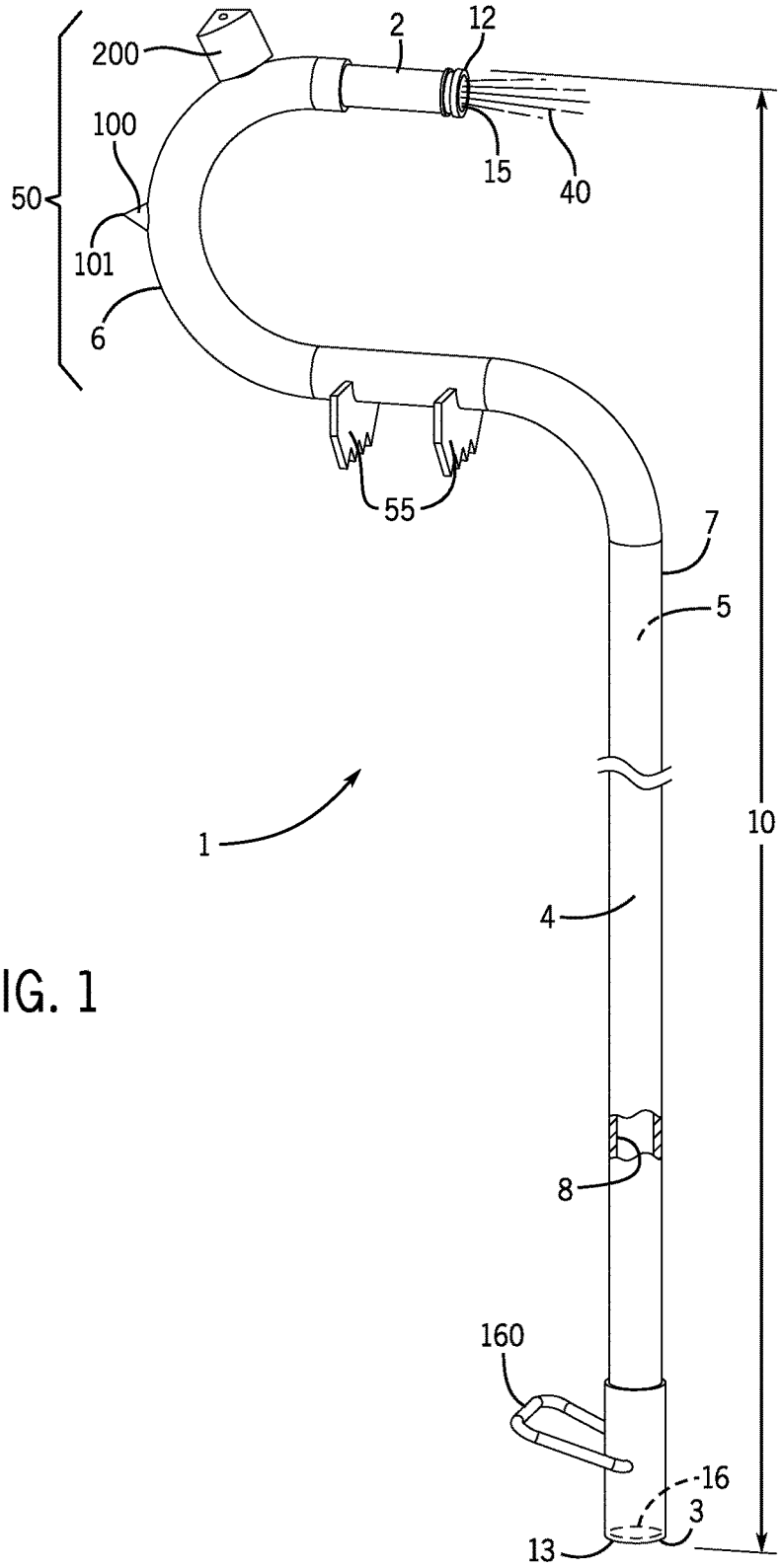
FIG. 1 illustrates a side view of the smoke eliminator device.

Referring now to FIG. 1, a smoke eliminator device 1 is provided. The smoke eliminator device 1 may be generally tube-shaped having a top 2, a bottom 3, a front 4, a back 5, a first side 6, a second side 7 and a generally hollow interior 8. The smoke eliminator device 1 may further have a length 10. Preferably, the length 10 is great enough so as to allow a fire fighter to be able to reach at least a second story window from the ground, but not so large that the device 1 becomes too heavy or becomes non-functional for a first story window. The smoke eliminator device 1 is made from a durable material such as, for example, a strong metal. The material should be durable enough so as to withstand the wide range in temperatures associated with fire-fighting. Water emitted from the distal end of the device creates a suction which pulls smoke and heat out of a room or building (and away from firefighters and victims). In particular, the water cools expelled heat and smoke which greatly decreases the chance of fire spreading.

The smoke eliminator device 1 may have a first end 12 located near the top 2 and a second end 13 located near the bottom 3 of the device 1. The first end 12 may have an opening 15 and the second end 13 may have an opening 16. The opening 15 of the first end 12 may extend to the opening 16 at the second end 13 so as to create a generally hollow passageway in the interior 8 of the device 1.

Figure 2:
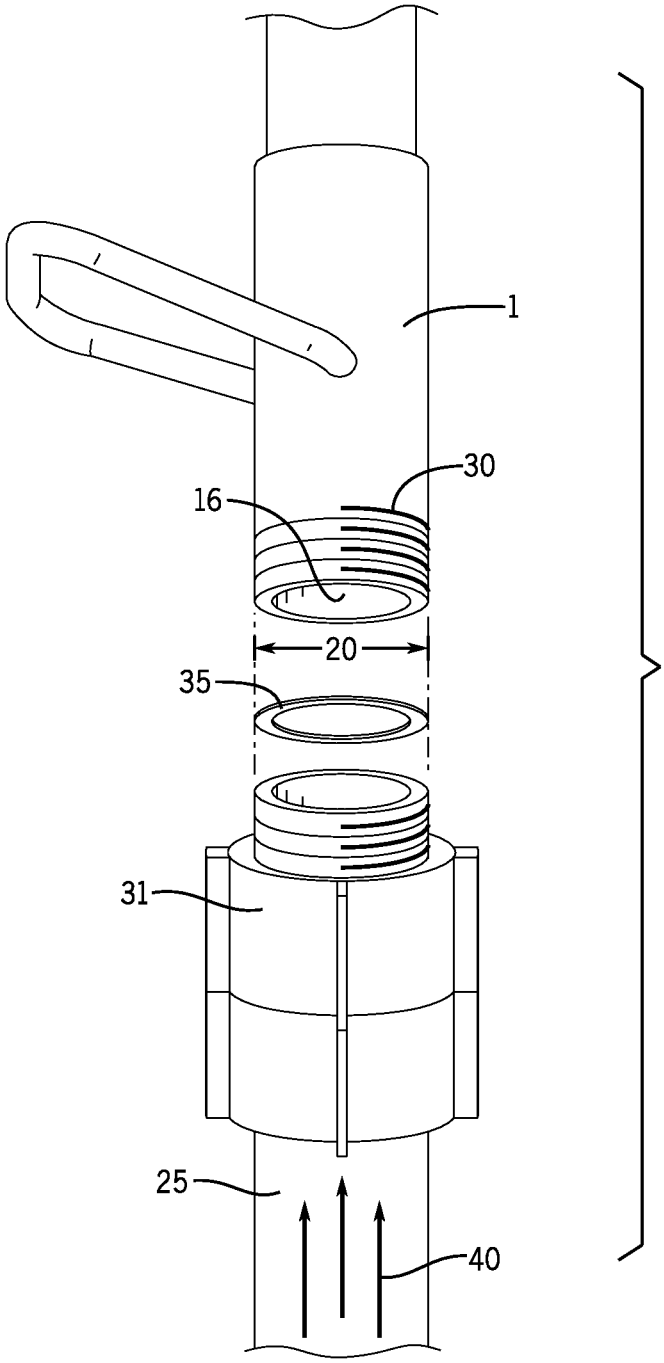
FIG. 2 illustrates a detailed view of the smoke eliminator device being secured to a fire hose.

Referring now to FIG. 2, the opening 16 at the second end 13 of the device 1 may have a diameter 20 which is substantially similar to a diameter of a standard fire hose 25 so that the opening 16 at the second end 13 of the device 1 may be temporarily secured to the fire hose 25. A sealing device 30 (such as a threaded member) on the second end 13 of the device 1 may correspondingly lock to a second sealing device 31 (having a corresponding threaded member) located on the fire hose 25. As a result, a liquid tight seal may be created between the device 1 and the fire hose 25. In an embodiment, a gasket 35 may be located at the opening 16 at the second end 13 of the device 1 to further prevent a gas or liquid from escaping between the device 1 and the fire hose 25.

Once the second end 13 of the device 1 is securely attached to the fire hose 25, water 40 may be introduced to the device 1 and may travel from the second end 13 of the device 1 to the first end 12 of the device 1 (as will be further described below). To remove the device 1 from the fire hose 25 the reverse process is followed as the device 1 may be temporarily secured to a fire hose 25.

The top 2 of the device 1 (near the first end 12) may have a generally "u-shaped" area 50. The generally u-shaped area 50 may extend away from the main body of the device 1 and then may curve back toward the main body of the device 1, similar to a hook. In an embodiment, at least one grasping mechanism 55 is located on the lower end of the u-shaped area 50. More specifically, the grasping mechanism 55 may extend downward, facing the bottom 3 of the device 1. In an embodiment, the grasping mechanism 55 extends downward in a generally perpendicular manner with respect to the lower end of the u-shaped area 50.

In an embodiment, the grasping mechanism 55 may be generally triangular in shape. FIG. 1 illustrates two grasping mechanisms 55 located on the lower end of the generally u-shaped area 50; however, any number of grasping mechanisms 55 may be used. In an embodiment with multiple grasping mechanisms 55, a user may hang the device 1 on, for example, a window sill, between two of the grasping mechanisms 55 such that the grasping mechanisms 55 prevent the device 1 from slipping off the window sill (See FIG. 5). As a result, the device 1 may be inserted in place on a window sill, turned on, and then left unattended while a firefighter attends to other urgent matters in fighting a fire.

As stated above, the grasping mechanism 55 may first be inserted over the window sill and the device 1 then turned on. Once on, the pressure of the water 40 may force the grasping mechanism against the window sill. As a result, when the water 40 is flowing through the device 1 the pressure of the water 40 secures the device 1 to a window sill and the user may leave the device 1 unattended. It is understood that the device 1 need not be used only in a window, but instead, a fire fighter may break a hole in, for example, the side of a building and may insert the device 1 into the hole and use the device 1 similar to the manner in which it is used for a window.

Figure 3:
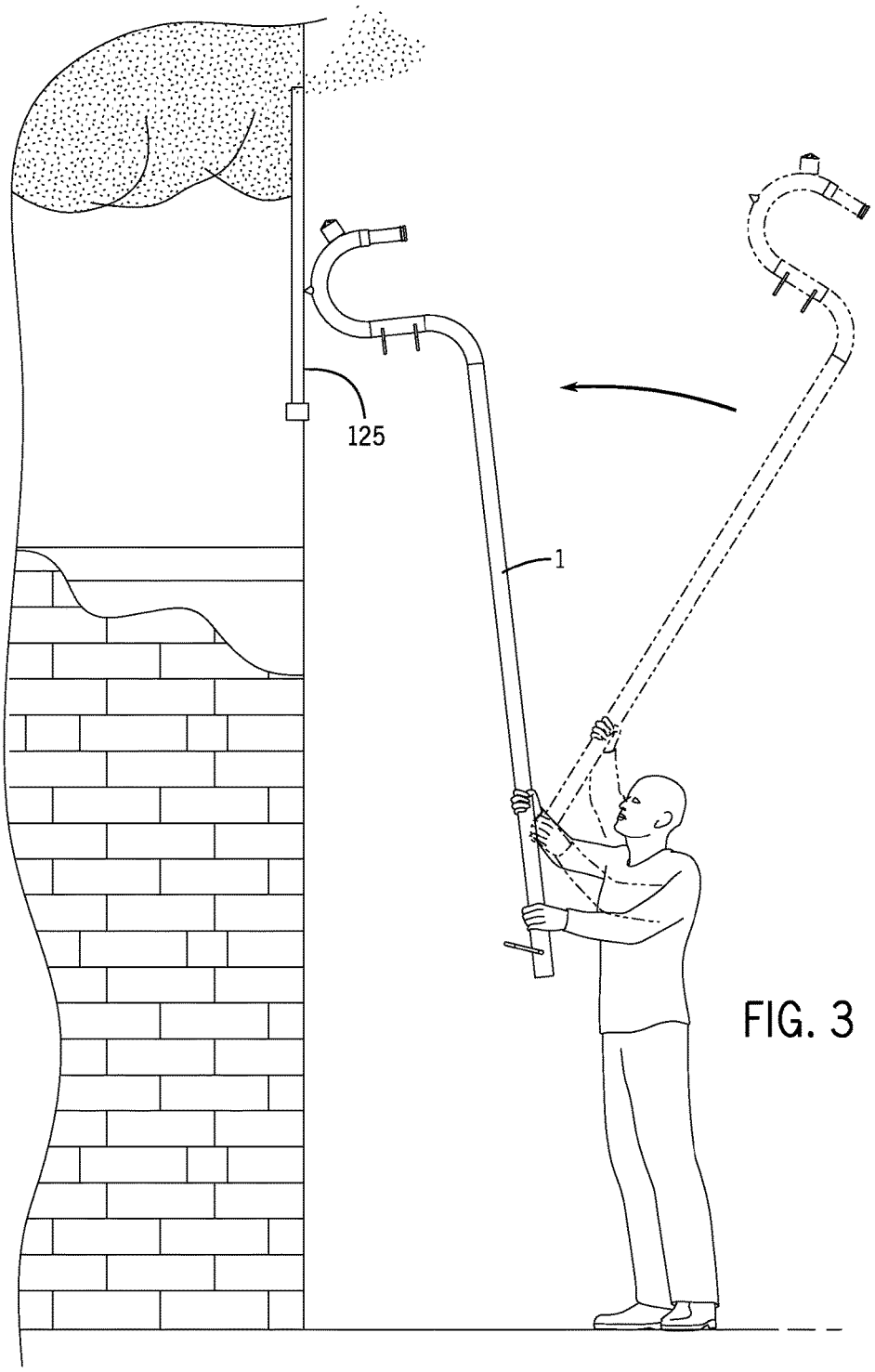
FIG. 3 illustrates a side view of the smoke eliminator device being inserted through the glass of a window wherein it may be effective.
Figure 4:
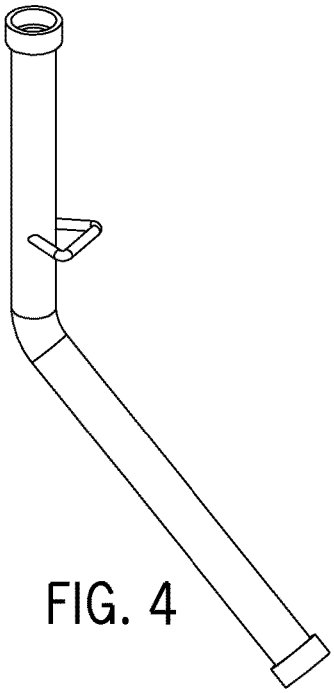
FIG. 4 illustrates a side view of the smoke eliminator wherein the device has a bend for utilizing the device out of a window.

In an embodiment, a glass-breaking device 100 may be located on the u-shaped area 50. It should be understood that the glass-breaking device 100 may be used to break surfaces other than glass, such as a thin wall. The glass-breaking device 1 may be located, preferably, at the bottom of the "U"; farthest away from the main body of the device 1. Preferably, the glass-breaking device 100 extends from the body of the device 1 at approximately a ninety degree angle. In an embodiment, the glass-breaking device 100 may be durable and may have a generally pointed tip 101. More specifically, the glass-breaking device 100 may be generally cone shaped ending at the generally pointed tip 101. As a result, during use, a great amount of force may be focused on the generally pointed tip 101 when a user swings the device 1 toward the glass 125 of a window (FIG. 3).

To use the device 1, the user first secures the device 1 to a fire hose 25; as described above. Once secured, the user grasps the device 1 near the bottom 3 of the device 1. In an embodiment, a handle portion 160 may be located near the bottom 3 of the device 1 so as to allow the user to easily grasp the device 1 and securly hold and move the device 1.

The user then swings the device 1 which sufficient speed such that the top 2 of the device 1 moves toward the glass 125 of a window with enough speed that the generally pointed tip 101 is able to easily break the glass 125 of the window.

In an embodiment, the top portion of the u-shaped area 50 may have a nozzle 200. The nozzle 200 may act as a port wherein water 40 traveling within the interior 8 of the device 1 may exit at a location other than the opening 15 at the first end 12 of the device 1 (See FIG. 5). The nozzle 200 may be adjustable so as to allow a user to determine the pressure and direction of water 40 which exits the interior 8 of the device 1 out the nozzle 200. The water 40 exiting the device 1 through the nozzle 200 may directly suppress and extinguish flames located in the room or building. In an embodiment, the nozzle 200 may be completely shut off so that all the water 40 exits the first opening 15 and thus the greatest possible suction is created to draw the smoke out of the window. Further, the nozzle 200 may be electively shut off so as to reduce water damage 40 which generally occurs during firefighting. Shutting the water 40 off promptly reduces water damage 40 which generally occurs during overhaul.

In an embodiment, the nozzle 200 may be of various sizes and shapes. Further, the nozzle 200 may allow various gallons of water 40 to be expelled depending on the specific requirements for the fire department utilizing the device 1. The water 40 exiting the nozzle 200 may not only extinguish a fire, but may also cool the area inside the building therein increasing safety for the firefighters and any occupants trapped in the building. In an embodiment, the nozzle 200 may face slightly backwards and up with a straight stream so as to minimize disturbance of ventilation air flow. The water 40 may then deflect off the ceiling in the room and smaller droplets may break into steam and may cool the room. The nozzle 200 may be fire resistant in construction with a minimum ¼ inch I/D hole for a flow rate to cool a 150 square foot room. (Stream can be any pattern or GPM according to a specific fire department's needs).

As stated above, once the glass 125 of the window is broken, the device 1 may be secured in the window. More specifically, the grasping mechanism(s) 55 may be used to hang the device 1 on, for example, a window sill. Once in place, the device 1 may be activated by turning on the fire hose 25 and allowing water 40 to flow through the device 1. Water 40 then flows from the second end 13 of the device 1 and exits the opening 15 at the first end 12 of the device 1. As water 40 exits the opening 15 of the first end 12 of the device 1 it is expelled from the device 1 in generally the opposite direction as the building. In particular, the water 40 is expelled approximately one hundred and eighty degrees with respect to the building. As the water 40 exits the opening 15 of the first end 12, a suction force is created from the water 40 forcing air away from the building. The suction therein strongly pulls smoke (and heat) from within the building out the window and leaves the interior of the room with reduced smoke presence and reduced heat. As a result, a firefighter located within the building may more easily view the interior of the building to look for trapped persons and/or to directly locate the fire in the building to extinguish the fire. In addition, the removal of the smoke and heat from the floor (often a foot to a foot and a half) allows firefighters and trapped individuals to much more easily breathe available air while walking or crawling to safety.

Figure 5:
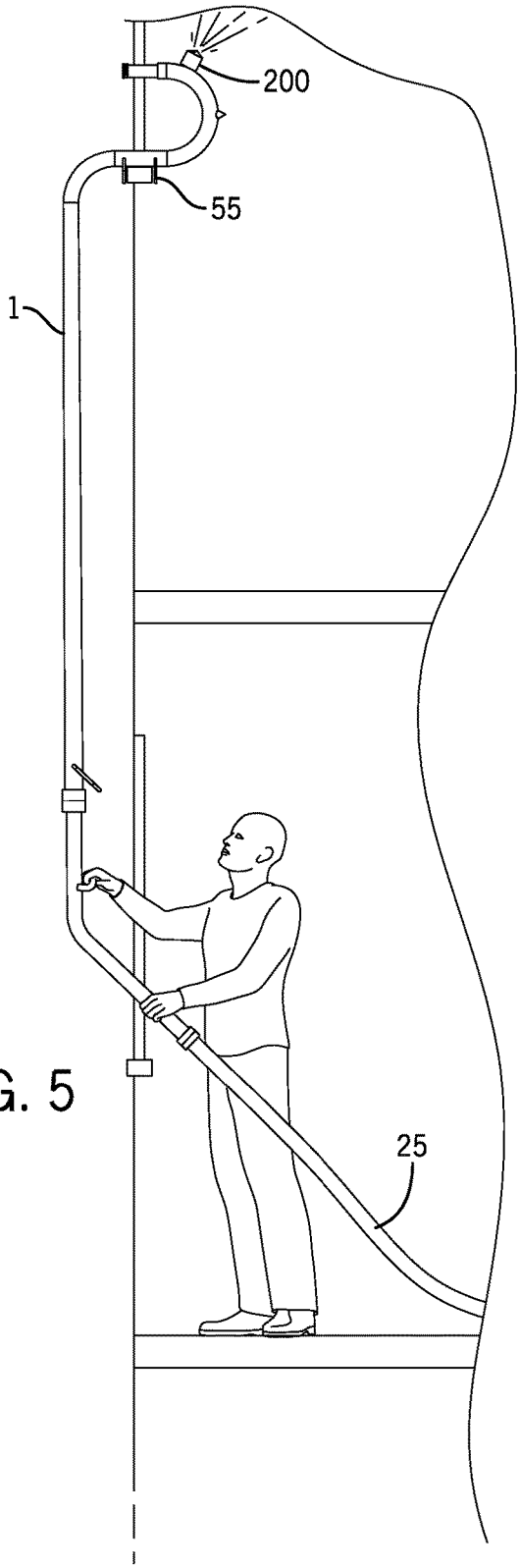
FIG. 5 illustrates a side view of the smoke eliminator device being used in a floor directly below a floor having a fire.

In an embodiment as illustrated in FIG. 5, the device 1 may be constructed in sections (or extensions). More specifically, the length 10 of the device 1 may be broken up into straight or bent sections of, for example, approximately three and a half feet in length. This allows the device 1 to be easily stored on fire-trucks and easily transported. Further, the plurality of extension pipes may be used so that a firefighter may utilize the device 1 for a fire occurring on an elevated floor of a building. The extensions of the device 1 may be substantially the same thickness as the main device 1 (FIG. 1) and may be attached directly to the fire hose 25 or may be connected to the main device 1 using standard fire department fittings.

Preferably, the bent extensions of the device 1 would have a forty-five degree bend in the lower end at where the shutoff and hose 25 would attach. In this embodiment, the extensions may have a handle at approximately the half-way point for ease of use. The extensions the device 1 may allow the first end 12 of the device 1 to be placed into a fire floor (located above a firefighter) from the floor below (safe area). Firefighters may enter the floor just below the fire, assemble the tool and grab the handle. The portion of the extension pipe having the forty-five degree bend angle may be placed outside of a lower window (while the firefighter is still inside the building) and may allow the device 1 to be used to fight a fire in the floor above the firefighter.

Figure 6:
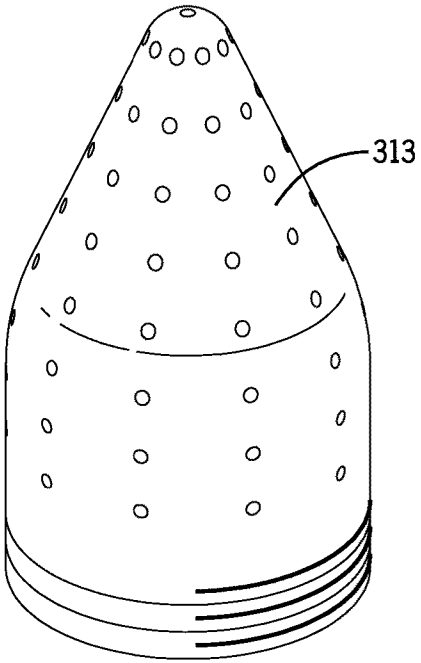
FIG. 6 illustrates a removable piercing nozzle of the device.
Figure 7:
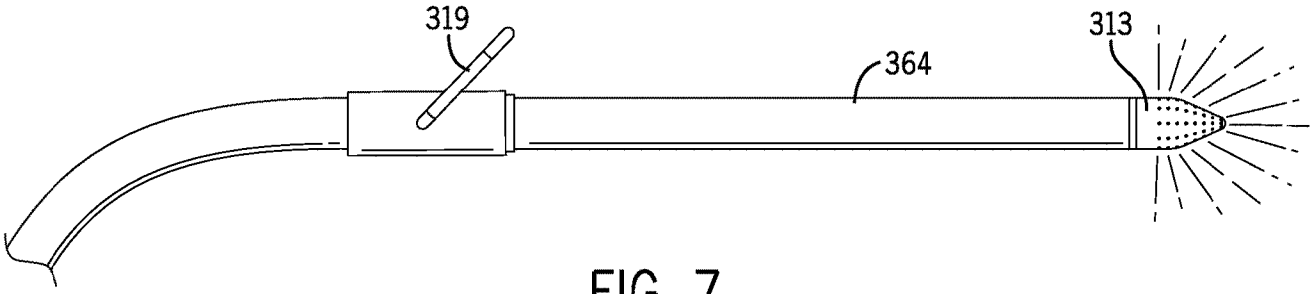
FIG. 7 illustrates the device with the removable piercing nozzle and a shut off valve.

Referring now to FIGS. 6 and 7, in an embodiment, a removable piercing nozzle 313 may be secured to a straight extension pipe section 364 without utilizing the main tube 1. The removable piercing nozzle 313 may be, for example, generally cone-shaped having a plurality of holes which allow water 40 to be expelled from the device 1 in a three hundred and sixty degree manner so as to better suppress a fire. Alternatively, the removable nozzle 313 may be used at the first end 12 of the device 1 to remove smoke and heat from the building (as is described above).

In an embodiment, the nozzle 313 may be a piercing nozzle which may be used to pierce through a glass window or to create a small hole in, for example, a thin wall as is often used in cars, tractor trailers, ceilings, floors, barns, storage units, etc. More specifically, a firefighter may swing the piercing nozzle 313 at, for example, glass or a thin wall to break the glass or thin wall with the piercing nozzle 313 tip. Alternatively, a hole may be drilled into a wall and the piercing nozzle 313 may then be placed inside the hole to expel water 40 onto the fire. As a result, the piercing nozzle 313 may be used to extinguish fires in hard to reach places. Still further, the piercing nozzle 313 may be used to pull smoke and heat from a fire even without the piercing nozzle 313 first being used to break glass 125 or creating a hole in a thin wall.

In an embodiment, an emergency cut off valve 319 may be located on the device 1. The emergency cut off valve 319 may be moved from a first position to a second position wherein the first position the water 40 may flow through the device 1 and wherein the second position the water 40 is prevented from flowing through the device 1.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

The invention claimed is:

1. A smoke eliminator apparatus comprising:

a first tube having a generally hollow interior, an exterior side, a top end having a first opening forming a first nozzle and a bottom end having a second opening wherein a fluid moves through the second opening at the bottom end of the first tube, through the interior of the first tube and then out of the first opening at the top end of the first tube;

a generally cone-shaped tip extended out from the exterior side of the first tube wherein the generally cone-shaped tip is used to break glass or to create a hole in a wall;

a second nozzle wherein the second nozzle is located directly on a u-shaped bend of the first tube and wherein the fluid moves substantially through the u-shaped bend prior to being split between the first opening and the second nozzle and wherein the fluid travels farther to exit the first opening then exiting the second nozzle;

wherein the cone-shaped tip is located directly on the u-shaped bend and substantially in the center of the u-shaped bend;

wherein the movement of the fluid out of the first opening of the top end of the first tube pulls smoke and/or heat out of a room in the direction of the fluid exiting the first opening at the top end by suction force of the fluid;

a non-flexible second tube having a first end and second end wherein the first end of the non-flexible second tube is temporarily and removably secured to the second opening at the bottom end of the first tube wherein a user may use the second tube to extend an overall length of the apparatus to reach a higher target area to eliminate smoke;

wherein the second tube is bent at an angle and wherein a portion of the second tube is located directly below the u-shaped bend when the first tube is in a vertical orientation such that the second tube bends in the same direction with respect to the first tube as the u-shaped bend of the first tube; and a flexible hose attached to the second end of the non-flexible second tube.

2. The smoke eliminator apparatus of claim 1 wherein the generally u-shaped bend near the top end of the first tube extends away from and then back toward a main body of the first tube in a generally perpendicular manner.

3. The smoke eliminator apparatus of claim 2 wherein the generally cone-shaped tip is perpendicularly located on the generally u-shaped bend.

4. The smoke eliminator apparatus of claim 2 further comprising:

a first grasping mechanism extending downward from the generally u-shaped bend wherein the first grasping mechanism is used to grasp a portion of a window sill or a hole in a wall and wherein the first grasping mechanism prevents the first tube from moving.

5. The smoke eliminator apparatus of claim 4 wherein the first grasping mechanism is generally triangular in shape.

6. The smoke eliminator apparatus of claim 4 further comprising:

a second grasping mechanism extending downward from the generally u-shaped bend wherein the second grasping mechanism is generally parallel with respect to the first grasping mechanism and wherein the first grasping mechanism and the second grasping mechanism straddle a window sill or hole in a wall and prevent the apparatus from moving.

7. The smoke eliminator apparatus of claim 1 further comprising:

a shut-off valve secured to the exterior side of the first tube wherein the shut-off valve allows a user to quickly prevent the flow of the fluid from exiting the first opening at the top end of the apparatus.

8. The smoke eliminator apparatus of claim 1 further comprising:

a handle secured to the exterior side of the first tube so as to allow a user to more easily grasp and move the first tube.

9. The smoke eliminator apparatus of claim 1 further comprising:

a removable tip temporarily secured to the first opening at the first end of the first tube wherein the removable tip has a plurality of holes which allows the fluid to exit the removable tip in substantially a three hundred and sixty degree manner.

10. The smoke eliminator apparatus of claim 9 wherein the removable tip is cone-shaped and wherein the cone-shaped removable tip is used to pierce through glass or used to create a hole in a wall.

11. The smoke eliminator apparatus of claim 1 further comprising:

a removable nozzle tip temporarily secured to the first opening at the first end of the first tube wherein the removable nozzle tip has a plurality of holes which allows the fluid to exit the removable nozzle tip in substantially a three hundred and sixty degree manner.

12. The smoke eliminator apparatus of claim 1 wherein the generally cone-shaped tip is located substantially in the center of a u-shaped bend of the first tube.

* * * * *